United States Patent [19]

Bocca et al.

[11] 4,322,864

[45] Apr. 6, 1982

[54] BINDING MACHINE FOR THE APPLICATION OF A STRIP OF FLEXIBLE MATERIAL AROUND THE OUTLINE OF THIN ARTICLES, PARTICULARLY FOR EDGING PARTS FOR BOOTS AND SHOES

[75] Inventors: Alberto Bocca; Mario Pagani, both of Vigevano, Italy

[73] Assignee: Sagitta Officina Meccanica S.p.A., Italy

[21] Appl. No.: 205,905

[22] Filed: Nov. 12, 1980

Related U.S. Application Data

[63] Continuation-in-part of Ser. No. 891,756, Mar. 30, 1978, abandoned.

[30] Foreign Application Priority Data

Apr. 1, 1977 [IT] Italy ..... 22031 A/77

[51] Int. Cl.[3] ..... A43D 43/06; B32B 3/04; F16H 21/00

[52] U.S. Cl. ..... 12/24.5; 156/461; 156/468; 156/480; 74/22 A

[58] Field of Search ..... 156/461, 468, 475, 478–480; 12/24.5; 74/22 R, 22 A

[56] References Cited

U.S. PATENT DOCUMENTS

| | | | |
|---|---|---|---|
| 2,407,310 | 9/1946 | Lundy et al. | 74/22 |
| 3,475,256 | 10/1969 | Bocca et al. | 156/480 |
| 3,483,579 | 12/1969 | Bocca et al. | 12/24.5 |
| 4,242,770 | 1/1981 | Boca et al. | 156/480 |

*Primary Examiner*—Edward C. Kimlin
*Assistant Examiner*—Lois E. Boland
*Attorney, Agent, or Firm*—Robert E. Burns; Emmanuel J. Lobato; Bruce L. Adams

[57] ABSTRACT

A binding machine for the application of a strip of flexible material around the outline of thin articles, particularly for edging parts for boots and shoes, comprising a fork with an alternating movement for folding the strip partly above and partly below the outline of a thin article, means for causing adhesive to be placed between the said strip and the said article, and a pressure and transportation group for the intermittent pressing of the strip against the article, after the folding operation performed by said fork, and for sending said article forward as it has been edged, said pressure and transportation group comprising a hammer shaped part and an anvil shaped part mounted on a hollow shaft oscillating about its axis, which parts are caused to move the one towards the other and vice versa by a rod placed in the hollow shaft and movable in a reciprocating way.

5 Claims, 14 Drawing Figures

BINDING MACHINE FOR THE APPLICATION OF A STRIP OF FLEXIBLE MATERIAL AROUND THE OUTLINE OF THIN ARTICLES, PARTICULARLY FOR EDGING PARTS FOR BOOTS AND SHOES

This is a continuation-in-part application of the application Ser. No. 891,756 filed Mar. 30, 1978, now abandoned.

BACKGROUND OF THE INVENTION

The present invention relates to a binding machine for the application of a strip of flexible material around the outline of thin articles, particularly for edging parts for boots and shoes, such as soles or insoles, with a strip of leather or similar material.

More precisely, the invention relates to a binding machine of the type that comprises a hollow shaft oscillating about its axis, a pressure and transportation group, driven by said shaft, said pressure and transportation group comprising a hammer shaped part and an anvil shaped part, a first rod in the hollow shaft coaxial therewith driven reciprocably longitudinally to control pressing of the strip in a folded condition, and a second rod parallel to said hollow shaft driven reciprocably longitudinally, a fork actuated by said second rod to fold the strip partly above and partly below an edge of a thin article before the pressing operation.

The known machines of this type have complex, costly, structures requiring special actuating units with which to operate the various component parts.

It is known a folding machine wherein the folding is got by means of a horizontal bar pivoted to a vertical rod having an end fastened to a driving rod operated in a reciprocating way according to an axial direction. Said bar is rested against an end of an arm turningly mounted upon a central pin and having, on the other end, a tooth which cooperates with a corresponding tooth of a clamp. Moreover, elastic means are provided to maintain in a horizontal position said bar, while, to get a correct folding of the edge a flexible material, it is necessary on the working plan the presence of an abutment having a curved surface with upwards concavity.

It is furthermore known a binding machine, wherein the working tools, which are the alternatively movable fork to fold the strip partly above and partly below the outline of the article and the pressure and transportation group to press the strip on the article and to remove the worked article, as driven by eccentrics mounted upon a shaft placed beneath the working tools. A system of leverages and rods, complexly assembled among each others, provide to transfer the movement from the driving shaft to the working tools.

The hereinbefore specified complicated driving mechanisms, besides negatively influencing the reliability and the manufacturing and maintenance costs of the binding machine too, need to be assembled into a box shaped body to avoid that the lubrication of the mechanisms causes sprays of lubricant around the working area. This box shaped body is placed upon the working plan of the binding machine causing encumbrance which limits considerably the available space to handle the piece to be worked easily and to make the binding operation difficult and imprecise. This happens particularly when soles and cork soles of women shoes are to be edged, because these ones are extremely shaped.

SUMMARY OF THE INVENTION

The main object of the present invention is to make available a binding machine so designed that its basic structure is simplied compared with that of known machines and that it can also be utilized for the creation of folding machines, that is to say, the machines used to fold and bond the welts on vamps, and on articles made of cloth or similar, in such a way as to allow unification and a consequent notable saving in the manufacture of binding and folding machines.

Another important object of the invention is to introduce improvements to the working parts of the binding machine, in such a way that accurate machining can be achieved with a high output and the minimum use of labour.

These and other objects too, which will eventually become apparent from the following description, are all attained with the binding machine forming the subject of the invention, which is characterized in that said hollow shaft is connected with said hammer and anvil shaped parts, a support arm mounted on the hollow shaft connecting said shaft to said hammer and anvil shaped parts, a leverage device comprising a lever centrally pivoted on a pivot supported by the support arm, a sleeve, said lever carrying on one end said hammer shaped part, and on the other end being articulated to said sleeve, said sleeve being slidingly mounted on said first rod, and another lever, centrally pivoted on said pivot, a link rod, said another lever carrying on one end the said anvil shaped part and the other end being articulated to said link rod at its lower extremity, the upper extremity of said link rod being articulated to an end of a bell crank lever pivoted on the support arm and having the other end articulated with said first rod, and said bell crank lever.

The advantages to be had with the invention lie, in particular, in the fact that the said base structure comprising said rods, provided with an alternating movement in an axial direction, one of which is inserted coaxially in the said hollow oscillating shaft, can be utilized not only to produce an improved binding machine of rational design and high output but also to construct a folding machine of conventional type, in such a way as to render unification possible in the manufacture of machines of the stated types.

Another important advantage got by means of the above binding machine is that the driving means of the fork and of the pressure and transportation group can be contained into a box shaped body having a reduced encumbrance so that the operator, having a wide work space at his disposal, can handle the piece to be edged easily, even if it relates to a sole or a cork sole much shaped as in shoes for women.

BRIEF DESCRIPTION OF THE DRAWINGS

One example of a preferred but not the sole form of embodiment for the invention is illustrated with reference to the accompanying drawings, in which.

DESCRIPTION OF THE PREFERRED EMBODIMENTS

Figure 1:
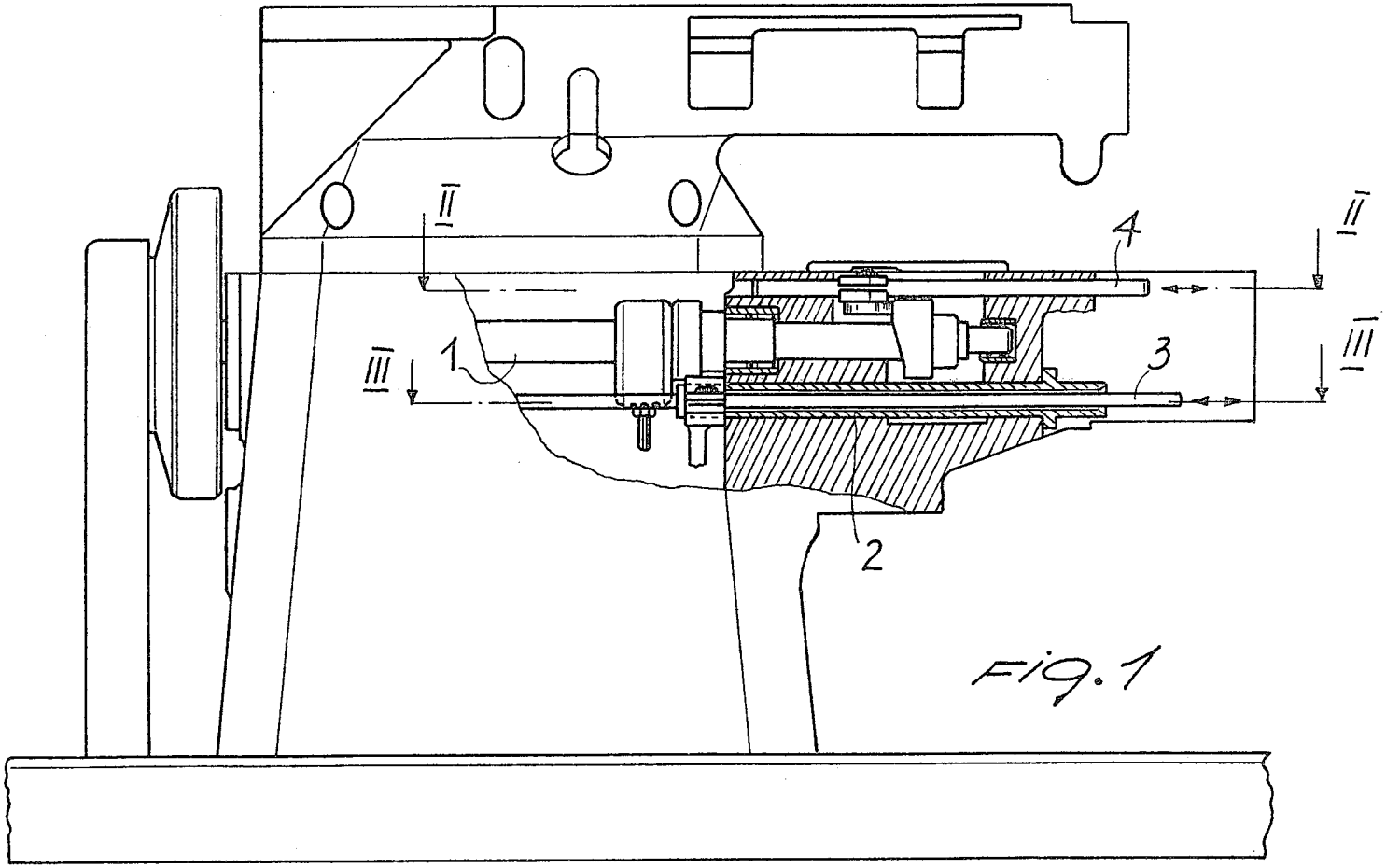
FIG. 1 is a partially sectional view, looking upwards, of the base structure of the binding machine.

In the aforementioned FIG. 1, a base structure is shown which comprises, inside a fixed housing, a drive shaft 1, positioned horizontally and designed to operate, through mechanical linkages which in themselves are already known, a hollow shaft 2 and two rods, 3 and 4, respectively, which are intended to be displaced axially to-and-fro. The said hollow shaft 2 is mounted parallel to the shaft 1 and the rod 3, as clearly shown in FIG. 3, and is accommodated coaxially therein.

The rod 4 is mounted parallel to the shaft 1, above the latter, and is axially displaced to-and-fro by means of a cam 5 rigidly mounted on the shaft 1, which engages with a roller (FIG. 2) carried by a block 7 integral with the said rod 4 and connected to the spring 8, the task of which is to maintain the roller 6 engaged with the cam 5.

The axial to-and-fro displacement of the rod 3 is controlled in an identical fashion.

A system of connecting rods, known in itself and not detailed in the following, then serves to get the hollow shaft 2 to briefly oscillate around its own axis.

Figure 2:
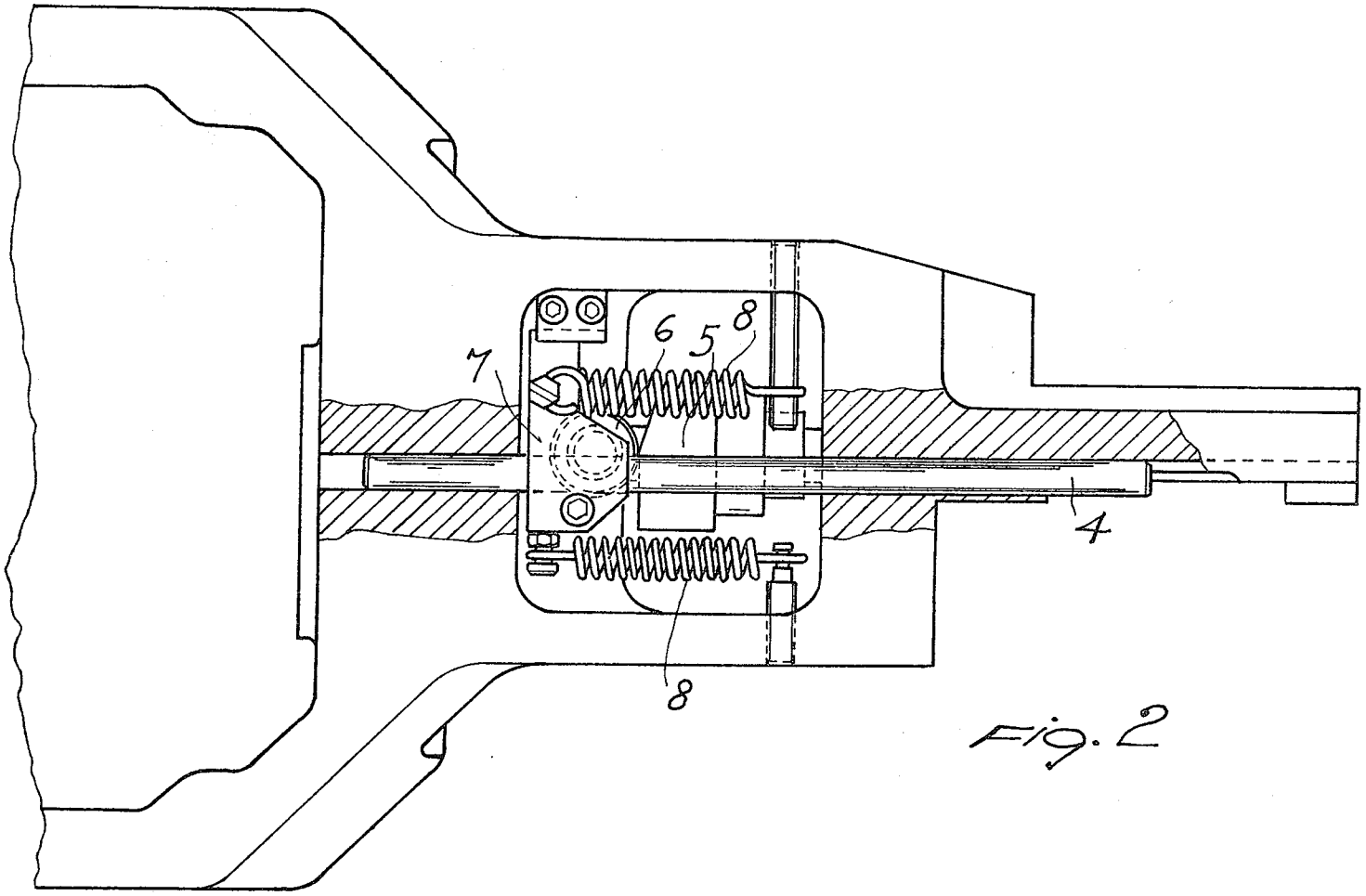
FIG. 2 depicts, in an enlarged scale, a horizontal section along the line II—II in FIG. 1.
Figure 3:
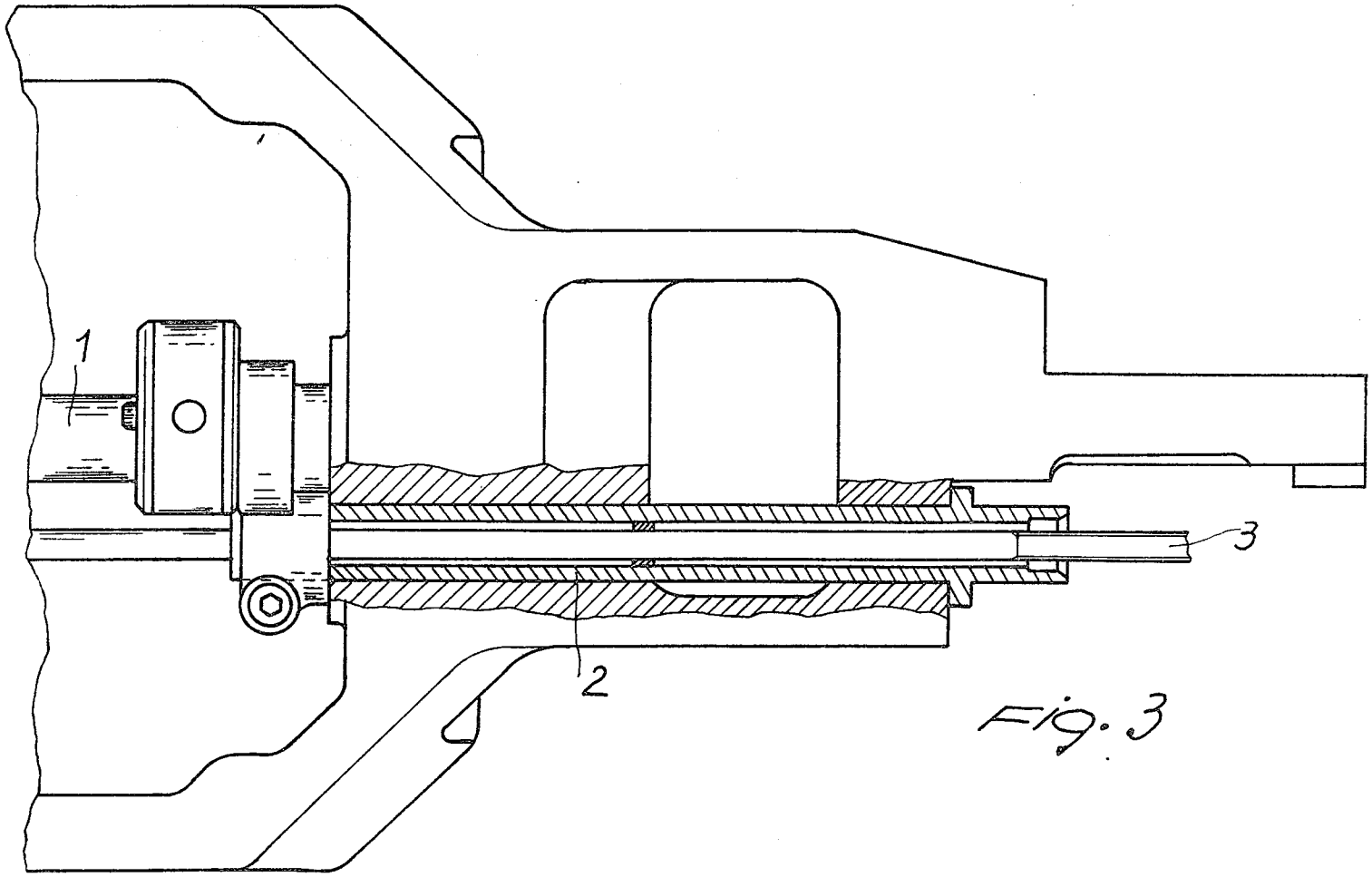
FIG. 3 depicts, in the same scale as for FIG. 2, a horizontal section along the line III—III in FIG. 1.

The base structure illustrated in FIGS. 1, 2 and 3 can be used not only to produce a binding machine according to the invention but also for the construction of a folding machine of the conventional type, for folding and bonding vamp welts and articles made of cloth or similar.

Figure 4:
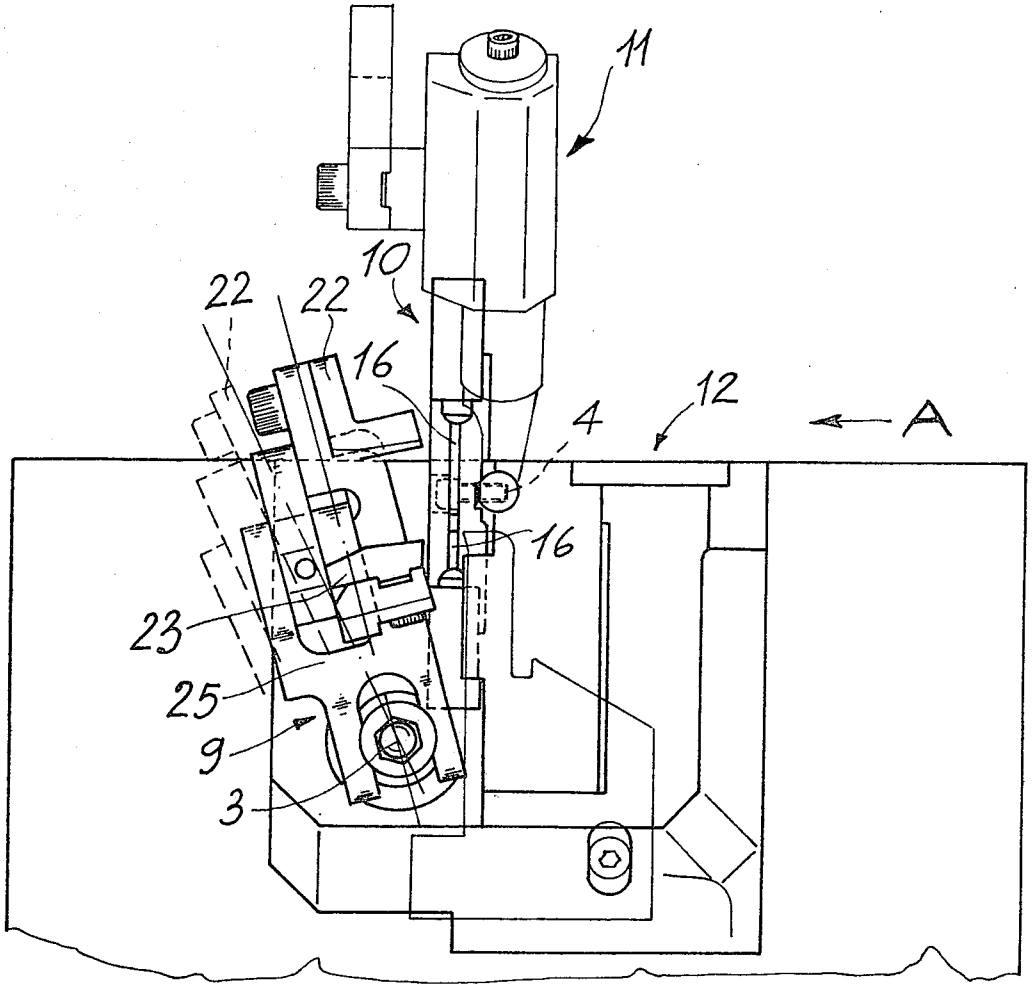
FIG. 4 is a front view of the main working parts of the binding machine.

Starting with the base structure, the binding machine according to the invention can be built by mounting on the front part of said structure a pressure and transportation group 9, a device 10 for folding the strip, a device 11 for supplying adhesive and a group (not depicted) for moving forward and cutting the strip, this latter group being in position 12 as shown in FIG. 4.

More particularly the group 12 for moving forward and cutting the strip is of the type described and shown in the American Patent Application Ser. No. 891,758 now U.S. Pat. No. 4,242,770 filed by the same applicants and already granted, to which it is possible to refer for further details.

The device 11 for supplying the adhesive, in itself known, comprises two nozzles 11*a* and 11*b*, respectively, mounted one opposite the other, which distribute the adhesive onto the upper and lower surfaces of the article 13 being machined. Furthermore, the said nozzles 11*a* and 11*b* serve to keep said article 13 in place when it is not being held by the pressure and transportation group. The lower nozzle 11*b* is fixed to the machine casing in a way which allows it to be adjusted, whilst the upper nozzle 11*a* is mounted on a lever 14 so that it can be raised when the articles 13 are inserted between the said nozzles and are removed therefrom.

As a consequence of the foregoing, said upper nozzle 11*a* is able to elastically vary its position. For the folding of the strip 15 partly above and partly below the outline of the article 13 being machined, the above mentioned device 10 is provided and this comprises a fork, the two limbs 16 of which are elastically thrust towards each other. To be more precise, said limbs 16 are mounted in an oscillating fashion on a support block 17 which is fastened to the outside end of the rod 4; the elastic thrust applied to the limbs 16 stems from two rung shaped members 18 mounted in the housings provided in the block 17, these being thrust towards the limbs 16 under the pressure of the springs 19. The position in which the linbs 16 are closest to each other can be set by means of two dowels 20 located in the block 17. As can be easily understood when consulting FIGS. 5 and 6, the reciprocating motion of the rod 4 and the irregular thickness of the articles 13 cause the limbs 16 to fold the strip onto the article 13 by elastically pressing down onto the said strip from opposite sides and thus the strip changes from the position shown in FIG. 5 to that depicted in FIG. 6.

Following on immediately after the device 10 with reference to the direction in which the strip moves forward (the arrow A in FIG. 4 indicates this direction), there is the pressure and transportation group 9 which, as will be seen more clearly later on, is pulled along by the hollow shaft 2 and the rod 3.

More precisely, the said group 9 comprises a support arm 21 shaped in the form of an L, which is fixed overhanging fashion to the outside end of the hollow shaft 2. Said arm 21 stretches parallel to the rod 3 to support a hammer shaped part 22 and an anvil shaped part 23, these being arranged opposite each other in the form of jaws which oscillate around a common pin 24 carried by the arm 21. As it is clearly shown in FIGS. 7, 8, 9 and 10, in order that the parallelism between the hammer 22 and the anvil 23 can be adjusted whenever the thickness of the articles 13 is considerable, said hammer 22 is secured, in an adjustable fashion, pivoted at 51, to one end of a lever 25 which is centrally pivoted to the pin 24, whilst the other end thereof, shaped in the form of a fork, is articulated at 26 to a sleeve 27 slidable along the rod 3. Said sleeve is held in a given position on the rod 3 with one side in contact with a nut 28 mounted on a threaded portion of said rod 3, and the other with a spring 29 threaded over the outside end of the said rod 3 and locked thereon by a pair of nuts 30.

The anvil 23 is fixed to one end of a lever 31 which is pivoted at an intermediate point to the pin 24, the other end of the said lever, shaped in the form of a fork 31*a*, being articulated to the lower end of a link rod 32. The upper end of said link rod 32 is, in turn, articulated to a fork shaped end of a bell crank lever 33 which is pivoted at 34 to a lug 21*a* on the arm 21. The other end of the bell crank lever 33, also shaped in the form of a fork, is articulated to a block 35 fixed, in a way that allows it to be adjusted, to the rod 3 (the conformation of said block is that of a sleeve which is inserted onto the rod 3 and is fastened thereto by means of a pair of nuts 36). The adjustment is effected in such a way that when the rod 3 is in its most retracted position (FIG. 7), the hammer 22 and the anvil 23 are so close together that they can even touch each other. When, for example, an article 13 is inserted between the anvil and the hammer, the rod 3 reaches its limit position just the same but the sleeve 27 undergoes a displacement with respect to said rod and compresses the spring 29. Both the anvil 23 and the hammer 22 are displaced around the pin 24 when the rod 3 is moved forward, and they move reciprocally away from each other until the maximum open position depicted in FIG. 8 has been reached. Indeed, as can be easily appreciated from FIGS. 7 and 8, the play on the various levers is such that as the anvil 23 moves downwards, the hammer 22 rises.

As the rod 3 continues to reciprocate in the direction of its axis, the oscillating motion of the hollow shaft 2 is operated synchronously in order to cause the group 9 to briefly a pendulum movement between the two positions shown in FIG. 4 with continuous lines and dashes, respectively.

The anti-clockwise displacement of the group 9, with reference to FIG. 4, takes place when the anvil and the hammer are in their closed position, whilst the clockwise displacement occurs at the time the hammer and the anvil are in their open position.

Thus a cyclic operating sequence is achieved in which a pressing operation is performed, in each cycle, as a result of the moving together of the hammer 22 and the anvil 23, whilst the article 13 subjected to this is displaced in the direction of the arrow A in FIG. 4.

Figure 11:
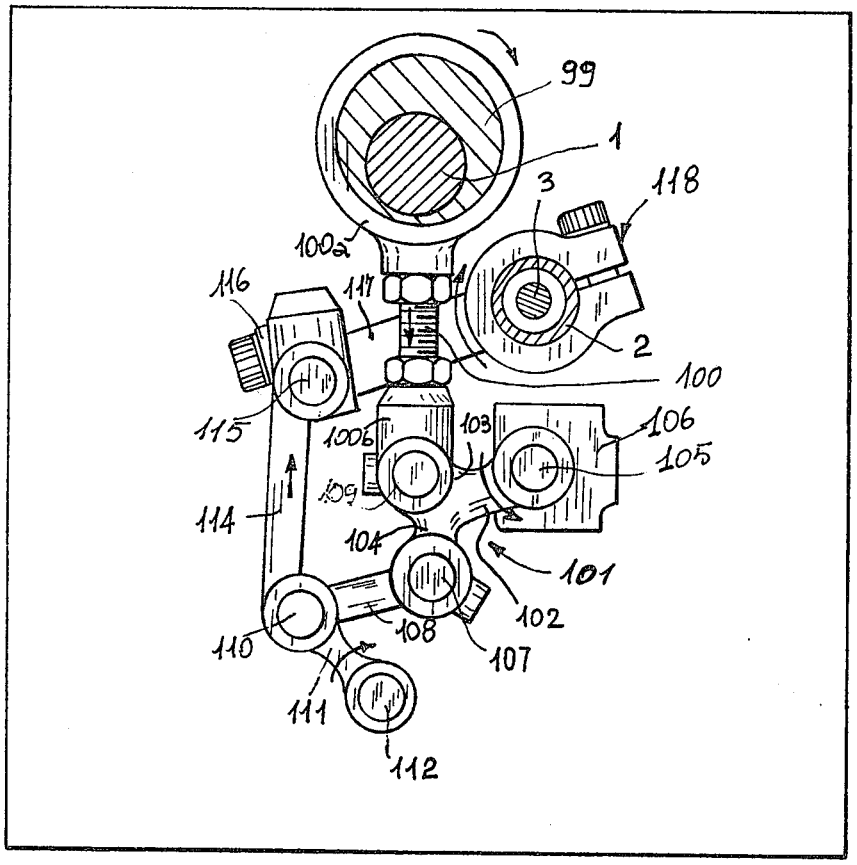
FIG. 11 is a cross section view of the mechanism imparting the oscillatory movement to the hollow shaft seen in a first end position.
Figure 12:
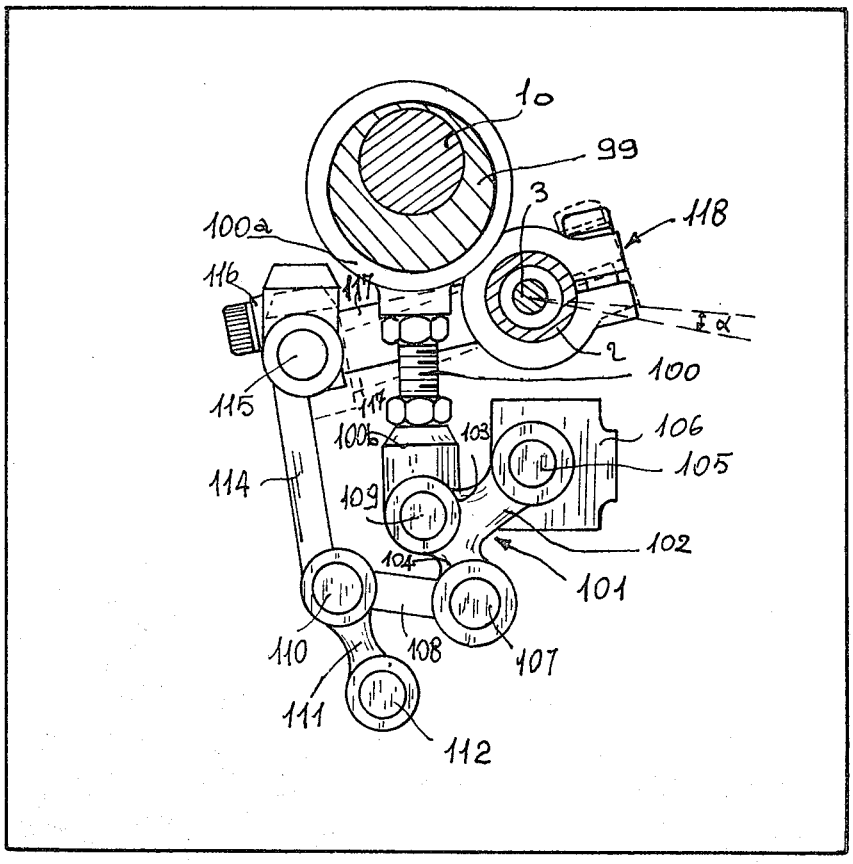
FIG. 12 is a cross section view as in FIG. 11 with the mechanism seen in second end position.

Referring to FIGS. 11 and 12, the mechanism which allows to get the oscillatory motion of the hollow shaft 2 is an eccentric 99 mounted on the drive shaft 1 of the machine. A collar shaped end 100*a* of a segment 100 is turningly mounted on the said eccentric 99. On the other end 100*b*, the segment 100 is connected to a first check rod 101 which is formed by three branches 102, 103 and 104 forming three 120° angles.

The end of the branch 103 is hinged to a pivot 109 at the end 100*b* of segment 100; the end of the branch 102 is hinged to a pivot 105 fixed to a bracket 106 integral to the base structure of the machine; the end of the branch 104 is shaped and provided with a cross pin 107, substantially at 90°, fulcrum of a second check rod 108.

The other end of the second check rod 108 is hinged to a pivot 110 serving also as a pivot for the end of a rod 111; the other end of the rod 111 is hinged in turn to a pivot 112 which is integral with the base structure of the machine.

The pivot 110 serves also as fulcrum for the end of the rod 114; the other end of the rod 114 is hinged to the pivot 115.

Fixed to the pivot 115 by means of a clamp 116 there is the end of a rod 117, the other end of which is locked by means of a clamp 118 to the hollow shaft 2 connected to the anvil 23 and hammer 22 and transmitting the oscillating rotatory movement thereto.

Figure 13:
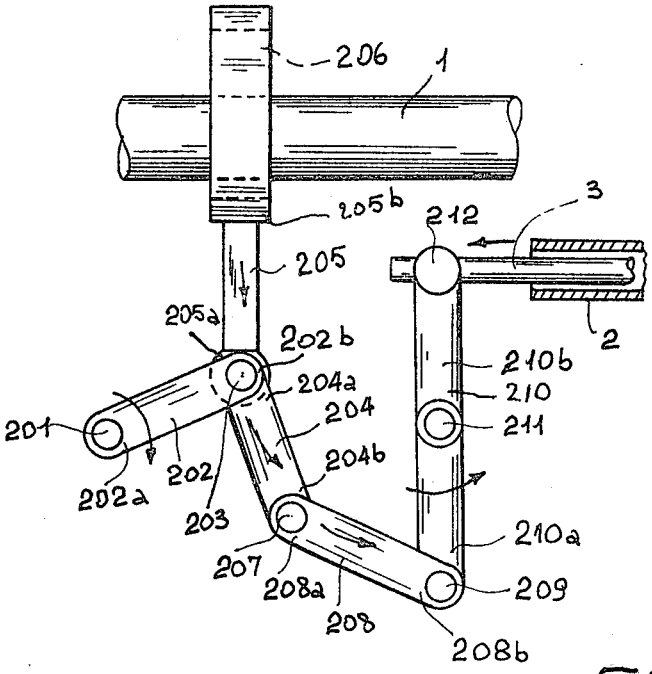
FIG. 13 is a side elevation view of the leverage imparting the reciprocating movement to the first rod seen in a first end position.
Figure 14:
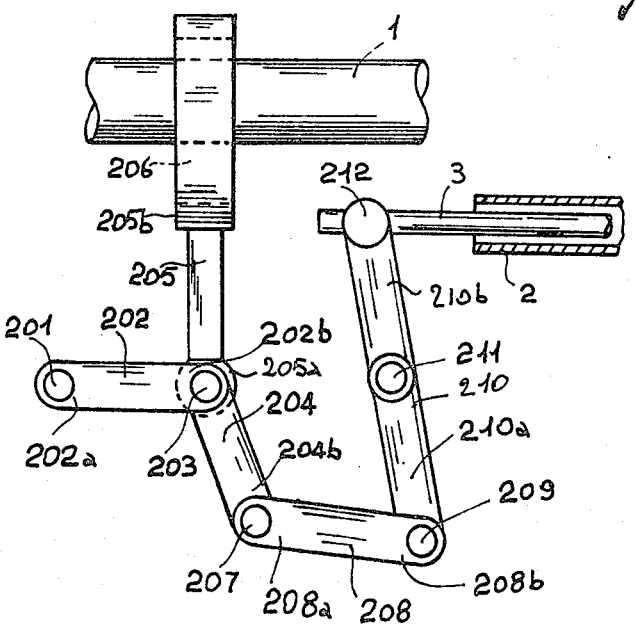
FIG. 14 is a side elevation view as in FIG. 13 with the leverage seen in a second end position.

Referring to FIGS. 13 and 14, the leverage which allows to get the reciprocating motion of the rod 3 driving the opening and closing of the hammer 22 on the anvil 23, comprises a pivot 201 (integral with the base structure of the machine), around which an end 202*a* of a lever 202 is pivoted. The other end 202*b* of said lever 202 is pivoted in 203 to an end 204*a* of another lever 204 and to an end 205*a* of a segment 205 whose other end 205*b* is shaped as a collar. The collar 205*b* of the segment 205 is turningly mounted on an eccentric 206 rigidly fixed on the shaft 1.

The other end 204*b* of the lever 204 is pivotally connected in 207 to an end 208*a* of lever 208 whose other end 208*b* is pivoted in 209 to an end 210*a* of a further lever 210 which is centrally hinged on a pivot 211 integral with the base structure of the machine. The other end 210*b* of the lever 210 is pivotally connected in 212 to the rod 3.

The operation of the binding machine described above takes place in the following way:

An article 13, for example, a sole to be edged, is placed in between the nozzles 11*a* and 11*b* once an adjustment has been made so that said nozzles keep the said article in position without, however, preventing it from sliding in the direction of the arrow A in FIG. 4 at the time it is being moved by the group 9.

Figure 5:
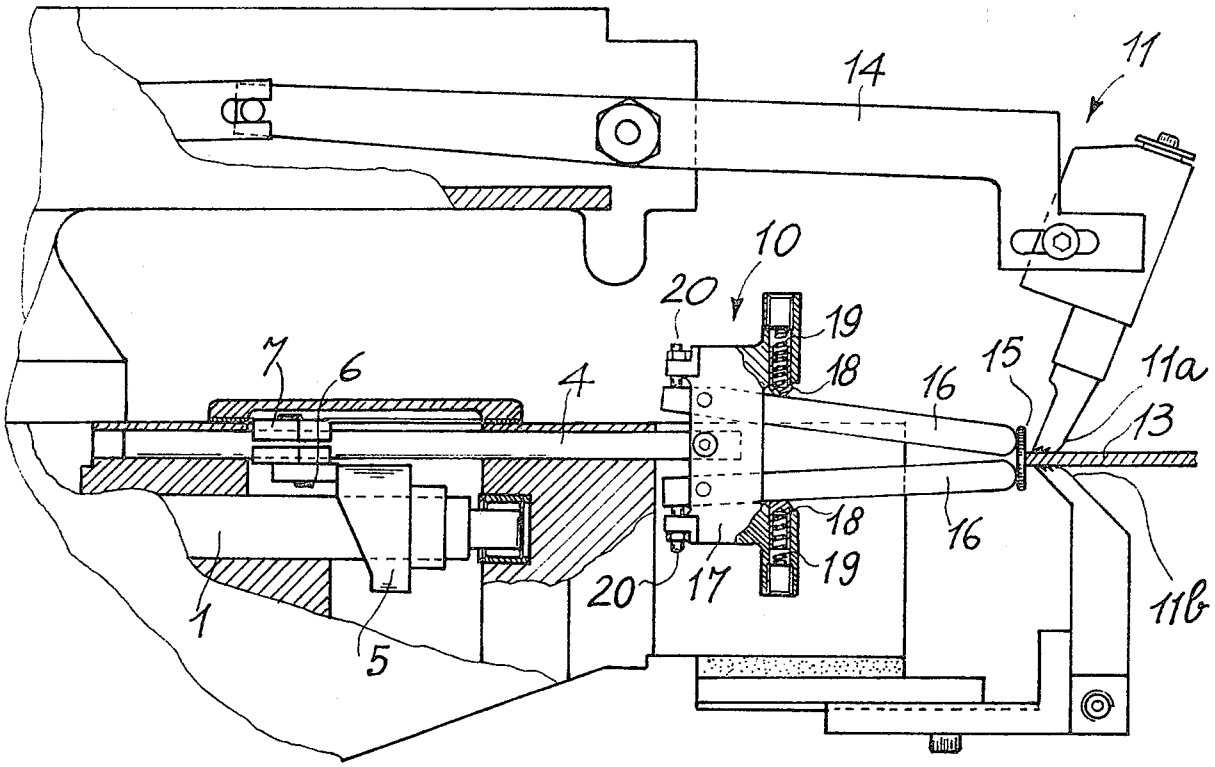
FIGS. 5 and 6 depict, in a lateral partially sectional view, the strip folding device, in two of its operative positions.

Furthermore, the sole 13 is positioned roughly on the centre line of the strip 15, as shown in FIG. 5.

Figure 6:
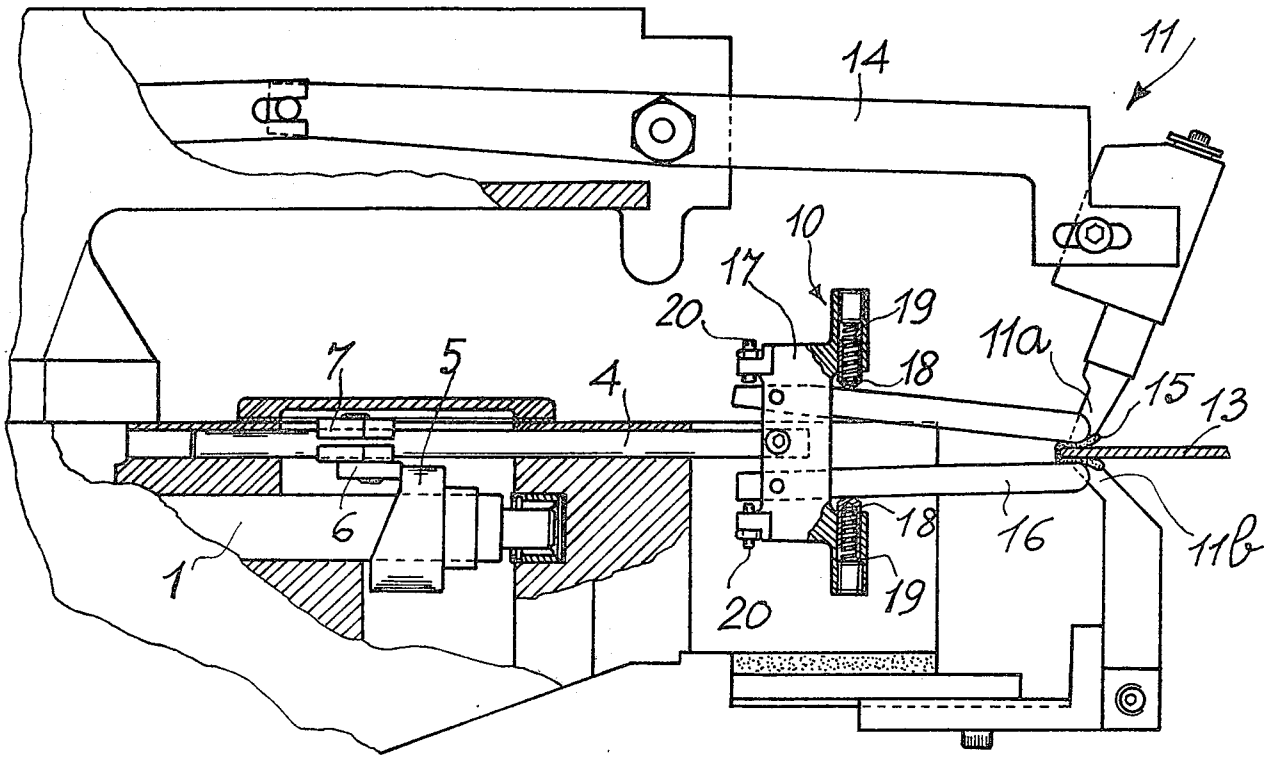
Figure 7:
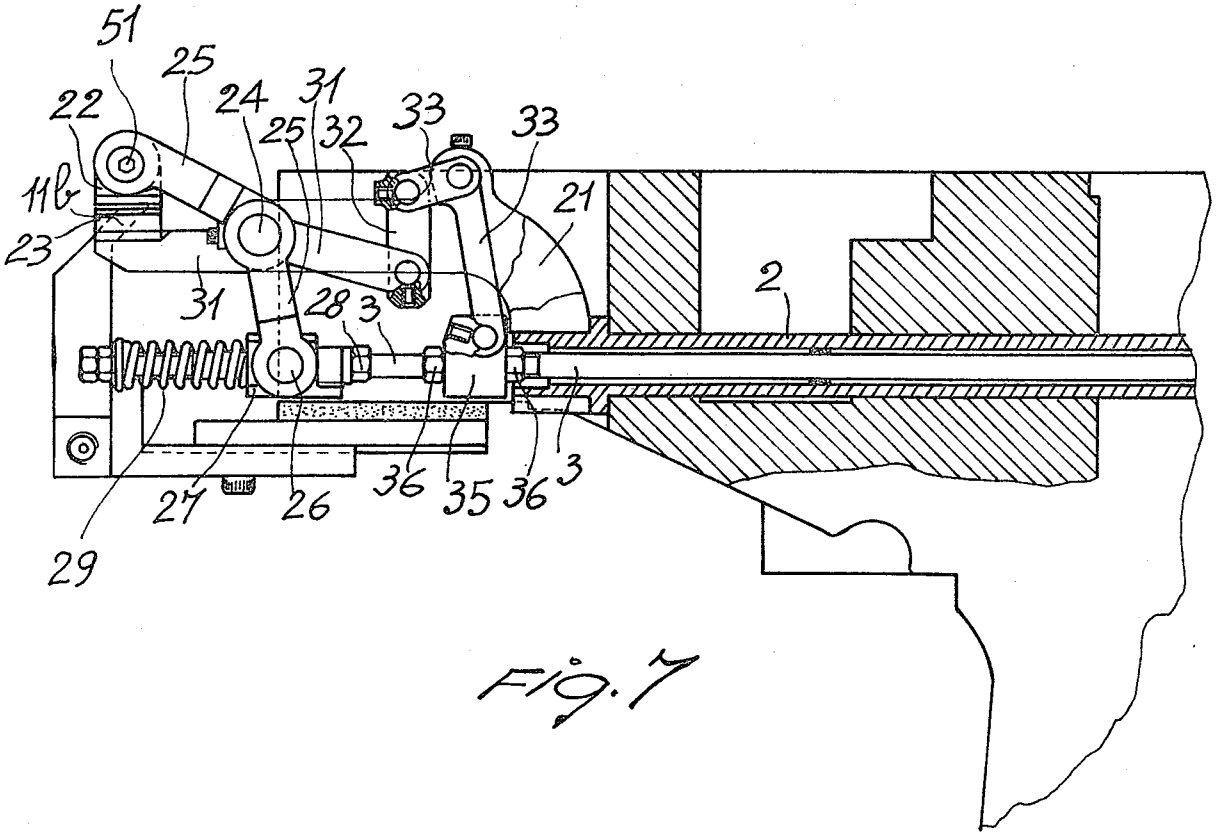
FIGS. 7 and 8 depict, in a vertical sectional view, the pressure and transportation group, in two of its operative positions.
Figure 8:
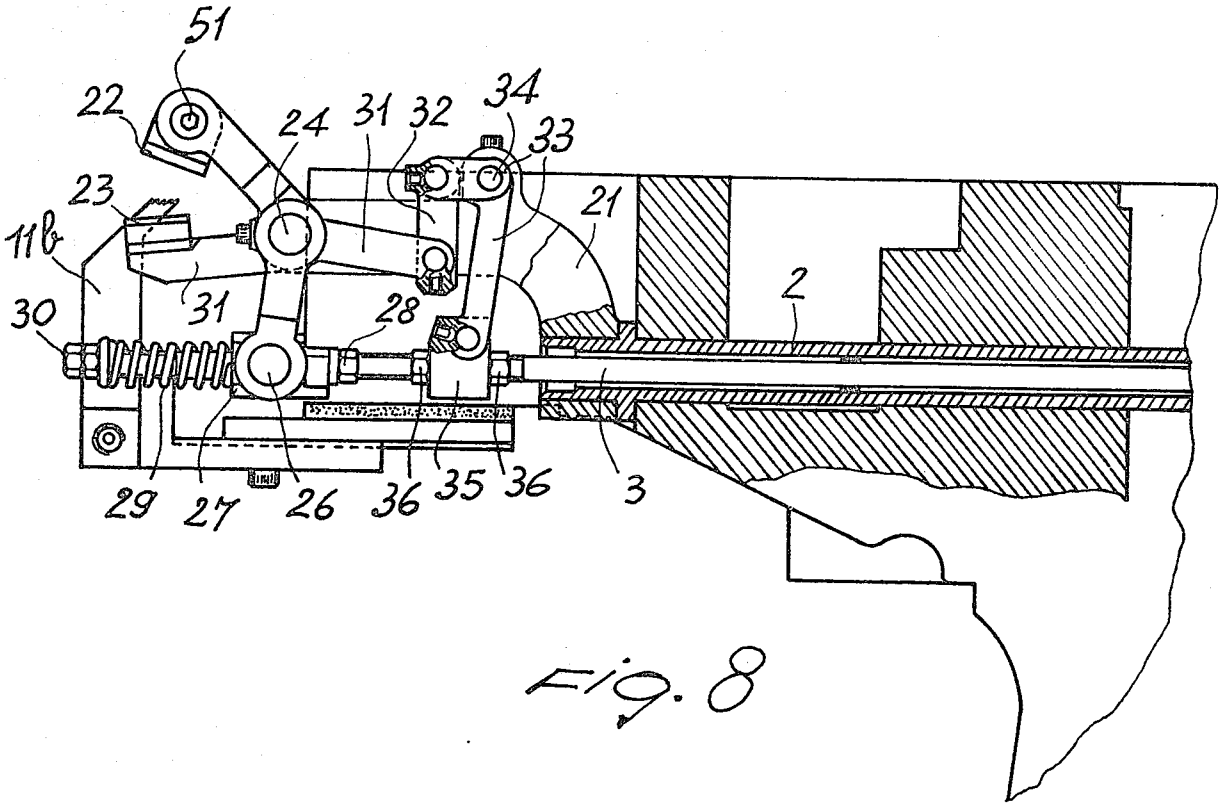
Figure 9:
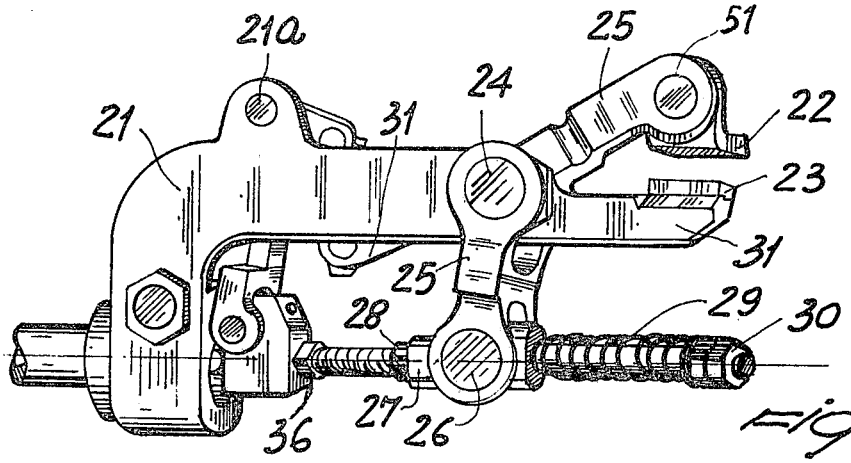
FIGS. 9 and 10 are perspective views of the pressure and transportation group, seen from one side and from the opposite side thereto, respectively.
Figure 10:
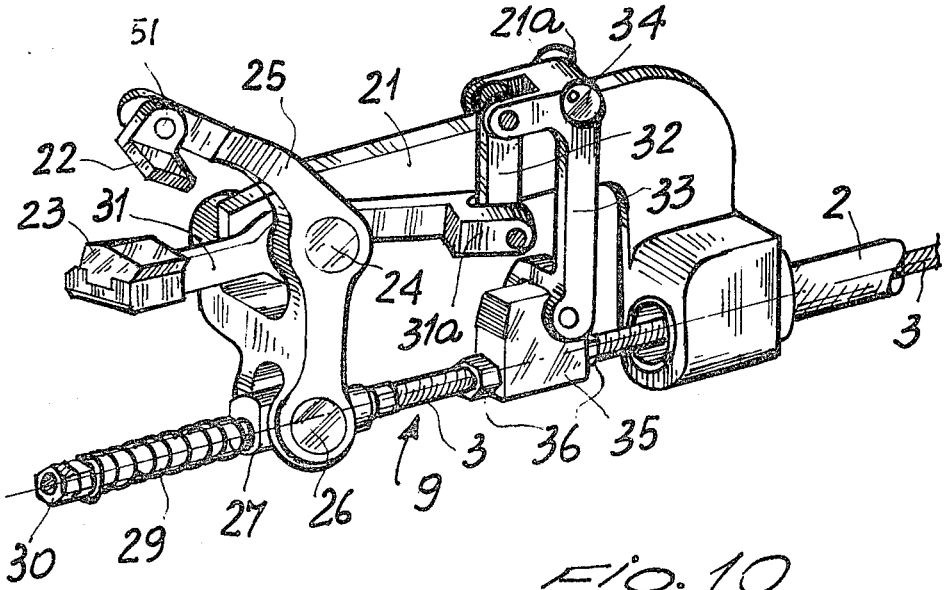

The nozzles 11*a* and 11*b*, as stated above, cause the adhesive to be distributed around the outline of the sole 13, on both sides thereof, whilst the fork 16, thanks to the to-and-fro motion takes from the rod 4, causes the strip 15 to be folded half above and half below the border of the article 13, as shown in FIG. 6.

At the same time, the oscillating movement of the hollow shaft 2 is made to synchronize with the reciprocating motion of the rod 3 and this brings about the pendulum movement of the group 9 around the axis of the shaft 2 and the opening and closing movement of the hammer 22 and the anvil 23, respectively.

The oscillating movement of the hollow shaft 2 is got according to the following way. When the eccentric 99, integral with the drive shaft 1, passes from the position shown in FIG. 12 (see the arrows shown in FIG. 11) causes the segment 100 to move downward. The check rod 101 rotates, according to a counter clockwise direction, around the pivot 105. During this motion the second check rod 108, which is engaged on a side to the branch 104 of the first check rod 101 and on the other side to the rod 111, causes this latter to rotate, according to a clockwise direction, around the pivot 112 integral with the base structure of the machine. Owing to this movement the rod 114, pivoted in 110 to the rod 111, moves downward causing a counter clockwise rotation of the rod 117 around the axis of the hollow shaft 2. This latter, being supported by its own fixed housing and being rigidly clamped by the clamps 118, integral with the rod 117, can rotate around its axis according to a prefixed angle indicated with the reference $\alpha$ in FIG. 12.

When the eccentric 99 fixed to the shaft 1 returns, owing to the continuous rotation of the shaft 1, to the initial position, all the elements of the mechanism move according to the above specified movements, but in a counter sense with respect to the arrows of FIG. 11.

As regards the exact motion of the rod 3 (FIGS. 13 and 14), when the shaft 1 rotates and the eccentric 206 passes from the position shown in FIG. 13 (hammer and anvil opened) to the position shown in FIG. 14 (hammer and anvil closed) the segment 205 drags the pivot 203 into a downward directed motion.

Owing to this motion of the pivot 203, the levers 204 and 208 are involved into a partially rotatory and partially translatory movement which causes the lever 210 to rotate, according to a counter clockwise direction, around the pivot 211 integral with the base structure of the machine.

This rotation of the lever 210 involves an axial leftward movement of the rod 3, with respect to the drawings.

When the eccentricity of the eccentric 206 is completely on the bottom of the shaft 1 we have the situation shown in FIG. 14, which corresponds to the condition of hammer and anvil closed. A further 180° rotation of the shaft 1 causes a rightwards desplacement of the rod 3 with reversal of the movements of all the levers and of the segment 205.

It is to note that the eccentricities of the eccentric 99 and 206 must be substantially dephased of a predetermined angle the one with respect to the other because, during a 180° rotation of the eccentric 206, the hammer 22, before exercising a pressure on the anvil 23, must take up the distance which separates it from the anvil 23.

The hammer 22 and the anvil 23, moreover, approach each other and move away from each other cyclically in synchronization with the oscillation of the full group 9, that is to say, they come towards each other during the anti-clockwise displacement of said group 9 (FIG. 4), and they move away from each other when said group is displaced in a clockwise direction.

The result of this is that a pressing operation is performed on both sides of the sole 13, following the reciprocal approach of the hammer 22 and the anvil 23, and that there is a step-by-step displacement of the sole and the strip in the direction of the arrow A in FIG. 4. Thus the strip 15 is bonded to the outline of the article 13.

In order to prevent the strip 15 from being subjected to stress, the movement of the fork 16 is made to alternate synchronously with the pendulum movement of the group 9 in such a way that the latter will only carry out the displacement operation when the fork 16 is in its retracted position (FIG. 5) or, in other words, when it is not engaged with the sole.

When the gauge of the articles 13 and/or of the strip 15 is varied, registrations can be effected to adjust the distance between the anvil 23 and the hammer 22 (this is done through the nuts 28 and 36), the distance between the limbs 16 (through the dowels 20), and the distance between the nozzles 11*a* and 11*b* (raising or lowering the nozzle 11*a* or 11*b*).

Each article 13 can be completely edged over the full outline thereof, accompanying it manually in order to turn it whilst it is being gradually displaced by the group 9, after which a cutting device (not illustrated) is placed in operation to cut the strip and allow the article to be discharged, once the nozzle 11*a* has been duly raised.

As can be seen, the binding machine according to the present invention enables accurate machining to be carried out, thanks above all to the rational way in which the groups 9 and 10 are structurally designed and, furthermore, to the fact that the machine is provided with a base structure which can be utilized, without any modification, for constructing folding machines (whose moving parts are special and differ from those required for edging), thereby making possible an advantageous unification in the building of the said machines.

This invention is naturally not limited to the form of embodiments described, and many modifications and changes are possible thereto.

What is claimed is:

1. A binding machine for the application of an edging strip of flexible material around an edge of thin articles particularly for edging soles of boots and shoes comprising, a hollow shaft oscillating about its axis, a pressure and transportation group, driven by said shaft, said pressure and transportation group comprising a hammer shaped part and an anvil shaped part, a first rod in the hollow shaft coaxial therewith driven reciprocably longitudinally to control pressing of the strip in a folded condition, and a second rod parallel to said hollow shaft driven reciprocably longitudinally, a fork actuated by said second rod to fold the strip partly above and partly below an edge of a thin article before the pressing operation, characterized in that said hollow shaft is connected with said hammer and anvil shaped parts, a support arm mounted on the hollow shaft connecting said shaft to said hammer and anvil shaped parts, a leverage device comprising a lever centrally pivoted on a pivot supported by the support arm, a sleeve, said lever carrying on one end said hammer shaped part, and on the other end being articulated to said sleeve, said sleeve being slidingly mounted on said first rod, and another lever, centrally pivoted on said pivot, a link rod, said another lever carrying on one end the said anvil shaped part and the other end being articulated to said link rod at its lower extremity, the upper extremity of said link rod being articulated to an end of a bell crank lever pivoted on the support arm and having the other end articulated with said first rod, and said bell crank lever; the first rod, the second rod and the hollow shaft being connected to a driving shaft for a common, synchronized drive and control.

2. A binding machine according to claim 1, in which said fork has limbs, a block integral with said second rod, means pivoting said limbs on said block, elastic means thrusting said limbs of the fork towards each other, and adjustable means for adjusting the position in which said limbs are closest to each other.

3. A binding machine according to claim 1, in which the hollow shaft is connected to the driving shaft by means of a mechanism comprising an eccentric fixed on the driving shaft, a segment having a collar shaped end turningly mounted on the said eccentric, a three branched lever having a first branch hinged to a pivot integral with the base structure of the machine, a second branch pivoted to the other end of the segment and the third branch hinged to one end of a leverage formed by three levers pivoted the one to the other at their ends, and a clamp integral to the free end of the last of said three levers which clamps the said hollow shaft.

4. A binding machine according to claim 1 in which the first rod is connected to the driving shaft by means of a leverage comprising a segment having a collar shaped end mounted on an eccentric fixed to the driving shaft and the other end hinged to a pivot around which are also hinged an end of a lever having the other end hinged to a pivot integral with the base structure of the machine, and an end of a lever whose other end is pivotally connected to a lever which engages an end of a further lever centrally pivoted and connected, on its other end, to the said first rod.

5. A binding machine according to claim 1, in which the second rod is connected to the driving shaft by means of a cam mounted on the driving shaft and engaging a roller carried by a block integral with the said second rod and connected to springs provided to maintain the roller engaged with the cam.

* * * * *